US006093064A

United States Patent [19]

Callen et al.

[11] Patent Number: 6,093,064

[45] Date of Patent: Jul. 25, 2000

[54] ENHANCED EMISSIVITY ELECTRICAL CONNECTOR

[75] Inventors: Brian William Callen, Brooklin; Roland Sion Timsit, North York, both of Canada

[73] Assignee: The Whitaker Corporation, Wilmington, Del.

[21] Appl. No.: 09/107,697

[22] Filed: Jun. 30, 1998

[51] Int. Cl.[7] ..... H01R 4/50; H01R 11/01

[52] U.S. Cl. ..... 439/783; 439/886; 439/797

[58] Field of Search ..... 439/783, 886, 439/485, 797; 361/704–708

[56] References Cited

U.S. PATENT DOCUMENTS

| | | | |
|---|---|---|---|
| 3,636,493 | 1/1972 | Caddock | 338/52 |
| 3,702,420 | 11/1972 | Cooper | 317/61 |
| 4,124,266 | 11/1978 | Wagstaff | 339/97 C |
| 4,397,716 | 8/1983 | Gilliland et al. | 204/33 |
| 4,464,005 | 8/1984 | Dwight | 339/112 R |
| 4,856,581 | 8/1989 | Santoro | 165/130 |
| 4,965,699 | 10/1990 | Jorden et al. | 361/387 |
| 5,059,143 | 10/1991 | Grabbe | 439/886 |
| 5,069,979 | 12/1991 | Nakajima et al. | 428/644 |
| 5,079,672 | 1/1992 | Haubner et al. | 361/387 |
| 5,126,533 | 6/1992 | Newman et al. | 219/385 |
| 5,199,894 | 4/1993 | Kalny et al. | 439/321 |
| 5,217,600 | 6/1993 | Le et al. | 205/328 |
| 5,244,422 | 9/1993 | Laricchia | 439/783 |
| 5,263,874 | 11/1993 | Miller | 439/487 |
| 5,273,439 | 12/1993 | Szerlip et al. | 439/66 |
| 5,353,191 | 10/1994 | Volz et al. | 361/690 |
| 5,367,196 | 11/1994 | Mahulikar et al. | 257/787 |
| 5,375,036 | 12/1994 | Magdaleno | 361/673 |
| 5,608,267 | 3/1997 | Mahulikar et al. | 257/796 |
| 5,662,353 | 9/1997 | Bergerson et al. | 280/737 |
| 5,692,821 | 12/1997 | Rodriguez, Jr. et al. | 353/52 |
| 5,713,748 | 2/1998 | Mulvihill | 439/98 |
| 5,908,898 | 6/1999 | Wan-Cheng et al. | 525/185 |

OTHER PUBLICATIONS

S. Wernick, R. Pinner, P. G. Sheasby, "The Surface Treatment and Finishing of Aluminium and its Alloys", Fifth Edition, vol. 1, ASM International, Finishing Publications Ltd., pp. 288–298, 1987.

*Primary Examiner*—Neil Abrams
*Assistant Examiner*—Hae Moon Hyeon
*Attorney, Agent, or Firm*—Michael J. Aronoff

[57] ABSTRACT

An electrical connector is disclosed for enhancing the thermal emissivity of an electrical connection. An electrical connector, such as a typical C-member and wedge style connector, is provided that is constructed of electrically conductive material and has a surface treatment on the exterior surfaces of the connector that increases emissivity of the connector. Contact surfaces are provided on the connector that are electrically conductive for ensuring electrical continuity within the connector. The surface treatment operates to increase the thermal transfer efficiency within the connector and thereby lower the operating temperature of the connector.

16 Claims, 5 Drawing Sheets

ENHANCED EMISSIVITY ELECTRICAL CONNECTOR

FIELD OF THE INVENTION

The invention is directed to an electrical connector comprised of electrically conductive material having a coating or surface treatment for increasing the emissivity of the connector.

BACKGROUND OF THE INVENTION

Electrical connectors of the type having a C-shaped body member having conductor receiving channels and a complimentary wedge member with concave sidewalls are well known. These connectors are utilized by placing a length of conductor in each conductor receiving channel and driving the complimentary wedge member within the C-shaped body to mechanically and electrically engage and retain the conductors. Typically, both the wedge and C-shaped member are made of electrically conductive materials such as aluminum alloy, and are used in power utility applications. Often, the connections are made and remain in an outdoor environment both above and under ground. As such, these connectors are subject to external elements such as sunlight, rain and extreme temperatures. Because of these extreme conditions, it would be desirable to protect these electrical connectors from degradation due to corrosive environments.

Because these connections are typically used in power utility applications, the wedge and C-shaped member are subject to high current loads. These high current loads dramatically increase the temperature of the connector and accelerate electrical contact degradation due to increased rates of oxidation, corrosion and inhibitor breakdown. Accordingly, it would be desirable to provide a built-in mechanism to radiate heat under high current loads thereby decreasing the temperature of the connector and reducing the side-effects caused by extreme temperatures.

A common method for reducing high temperatures occurring at electrical connections is by providing a heat sink which is mounted to the electrical connector. The heat sink is typically made from a material which is thermally conductive but electrically non-conductive and functions to provide a path for thermal transfer from the electrical connector to the heat sink. As a result, the heat is transferred away from the electrical connector through the heat sink material and dissipated across the surface of the heat sink. Examples of heat sinks used with electrical connectors can be found in U.S. Pat. Nos. 5,263,874 and 5,353,191.

One problem with the use of a heat sink is that they are separate and additional parts which add weight and complexity to the connector. Furthermore, since heat sinks rely on increased surface area to dissipate heat, they are generally large in size and thus require significant amounts of thermally conductive material which adds to the cost of the connection.

Anodized aluminum and its alloys, among others, has been identified as an effective material for use in heat sink applications. Anodic coatings, such as those used with anodized aluminum, increase the heat transfer efficiency of a heat sink by altering the surface thermo-optical properties of the underlying material. By optimizing the heat transfer efficiency of the particular material used in a heat sink, one is able to minimize the size and weight of the heat sink.

SUMMARY OF THE INVENTION

Accordingly, it is an object of the present invention to provide a built-in mechanism within an electrical connector which will radiate heat away from the electrical connection without the addition of an extra part in the form of a heat sink. A further object of the invention is to provide a built-in mechanism for radiating heat away from an electrical connection which is under high current loads. Another object of the invention is to provide a coating for an electrical connection which is inexpensive, robust and not susceptible to degradation by corrosive environments.

In accordance with the teachings of the present invention, there is provided an electrical connection comprising at least one pair of electrically mating members, at least one of the mating members having a surface treatment having high emissivity, and both members having at least one surface portion for mating engagement with the surface portion of the other member that is electrically conductive.

As the field of power utility places high current load demands on electrical connectors, an embodiment of the present invention provides an electrical connector comprising a tapered C-member of electrically conductive material having an anodic coating. The C-member forms two inwardly facing channels running longitudinally with the C-member. Each channel is capable of receiving a length of an electrical conductor and has an electrically conductive surface portion free of the anodic coating. A wedge of electrically conductive material having an anodic coating is also provided. The wedge has two concave sidewalls running longitudinally to the wedge. The concave sidewalls have surface portions that are electrically conductive and free of the anodic coating and are positioned to electrically and mechanically engage and retain electrical conductors within the inwardly facing channels of the C-member.

The following description of the invention is directed to a standard C and wedge connector constructed of aluminum alloy. However, it must be understood that the present invention has equal application in electrical connectors utilizing other electrically conductive materials manifested in forms other than the standard C and wedge. For example, an electrically conductive material such as copper could be treated with a surface treatment or coating to replicate the results obtained using an anodized aluminum alloy. Similarly, the use of an anodic coating treated directly onto an electrical connector such as a bolt driven utility connector would perform equally as well as the anodized coating used on the standard C and wedge connector, provided that the electrical contact surfaces remain free of the anodized coating and therefore continue to provide electrical continuity within the connection. In addition, other surface treatments could be used on various electrically conductive materials, provided that the coatings or surface treatment increases the emissivity of the connector and does not significantly add insulative properties to the connector.

BRIEF DESCRIPTION OF THE DRAWINGS

An embodiment of the present invention will now be described in detail with reference to the accompanying drawings, in which.

DESCRIPTION OF THE INVENTION

Figure 1:
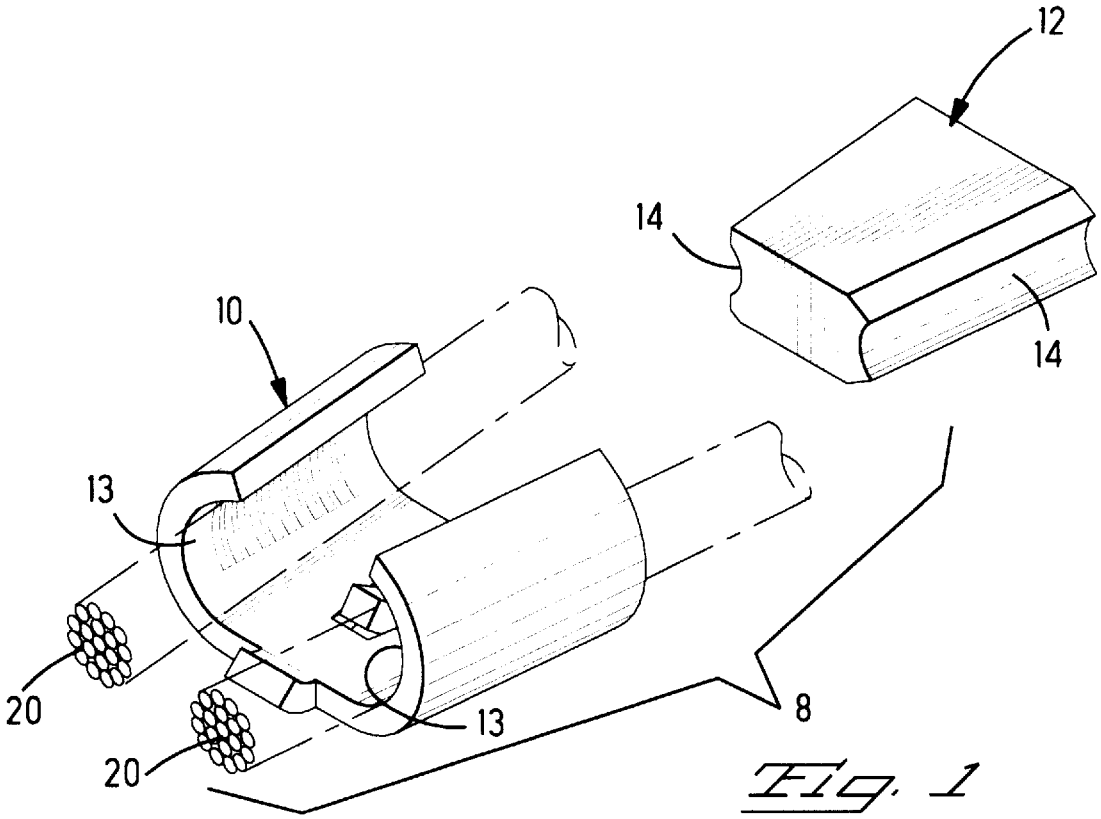
Fig. 1 PRIOR ART
FIG. 1 is an exploded isometric view of a prior art C-member and wedge connector.
Figure 2:
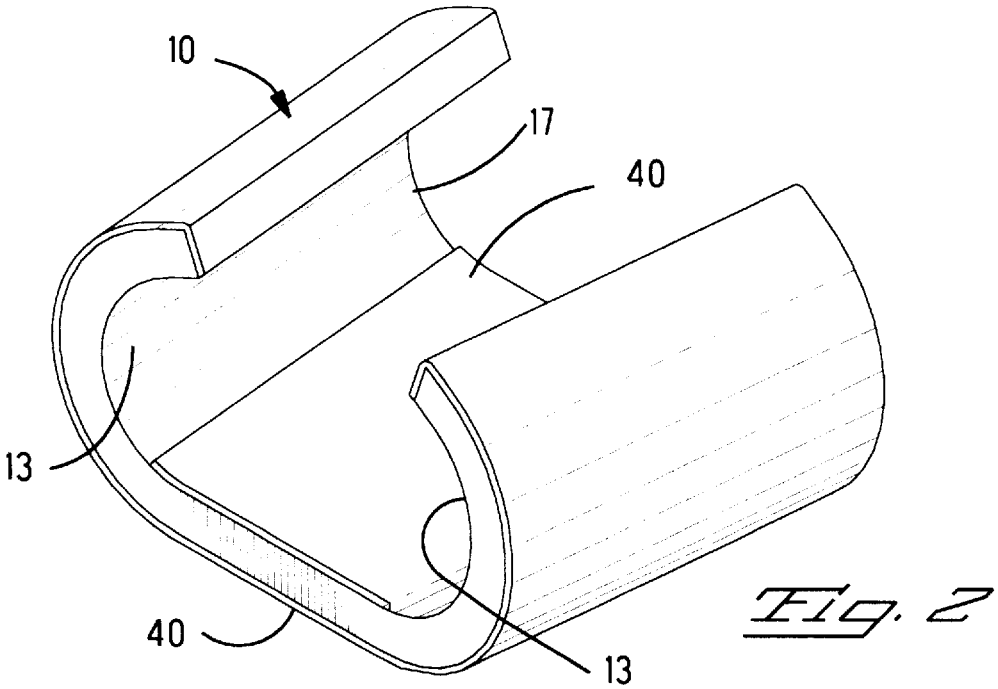
FIG. 2 is an isometric view of an anodized C-member.

FIG. 1 illustrates a typical C-member and wedge connector 8 without a surface treatment. The C-member 10 has an elongated tapered body having inwardly facing channels 13 for receiving conductors 20. The C-member 10 is formed from an electrically conductive material, such as an aluminum alloy. The C-member 10, as shown in FIG. 2, is treated with an anodic coating 40 covering nearly the entire surface of the C-member. However, as shown in FIG. 2, the interior surface 17 of the inwardly facing channels 13 is free of the anodic coating 40 present on the remainder of the C-member. Techniques such as stripping or masking, may be utilized to achieve the exposed interior surface 17 which is free of the anodic coating. Stripping takes place after the C-member is treated with the anodic coating and is accomplished by mechanically or chemically removing the anodic coating from the interior surface 17 of the inwardly facing channels 13. Masking takes place prior to the anodization process by protecting the interior surface of the inwardly facing channels thereby preventing anodization from taking place on the surfaces. It should be understood that other techniques may be employed for preparing the interior surface of the inwardly facing channels provided they result in an exposed electrically conductive surface capable of receiving and electrically engaging conductors 20.

Figure 3:
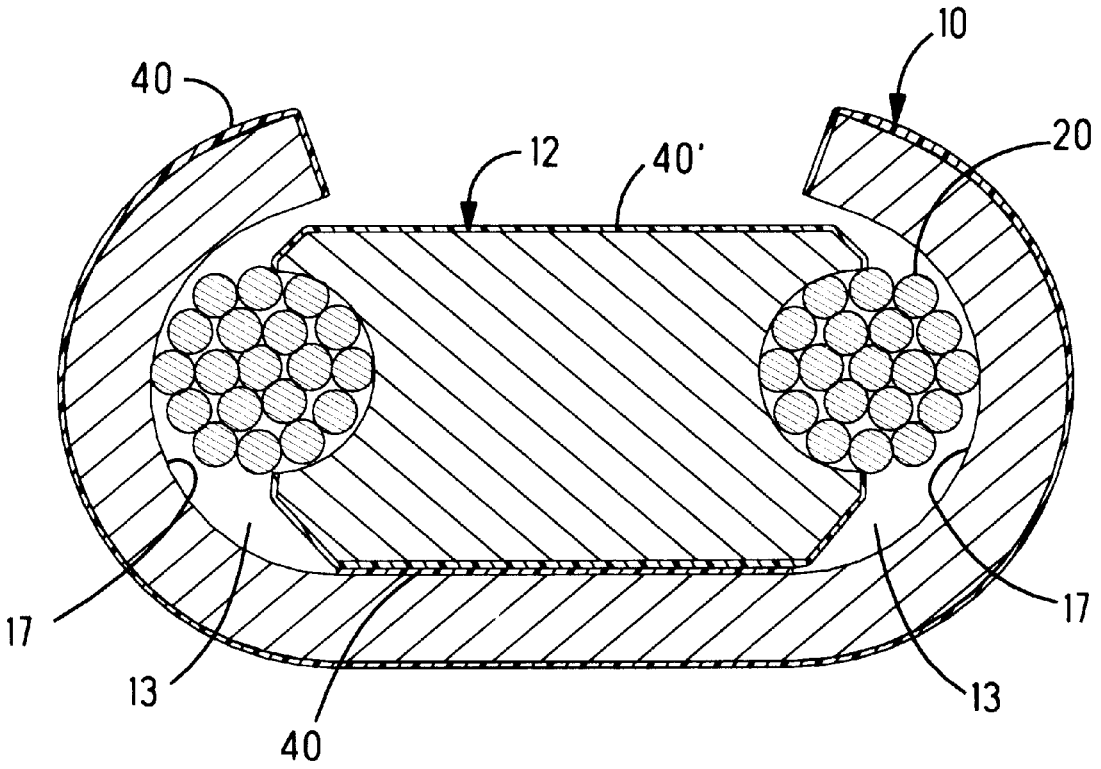
FIG. 3 is a cross-sectional view of an assembled C-member and wedge connector having an anodic coating.
Figure 4:
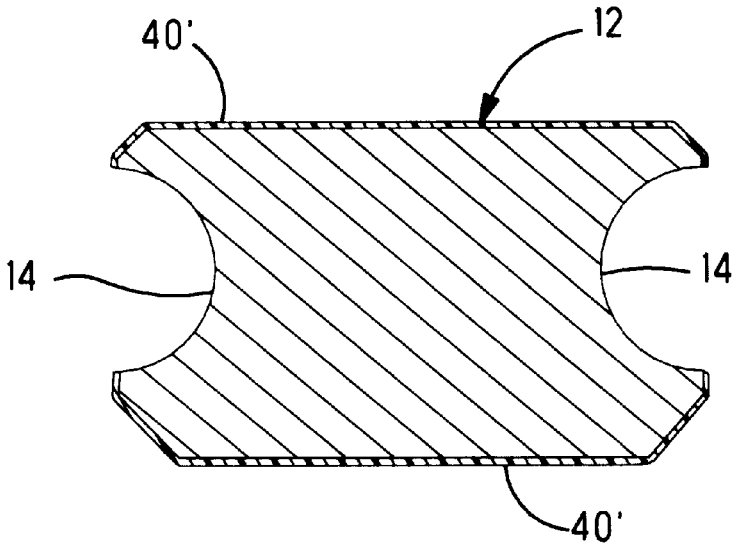
FIG. 4 is a cross-sectional view of anodized wedge member.

A wedge member 12 is shown in FIG. 1 having a complimentary tapered shape to that of the C-member 10 and further having concave sidewalls 14 for electrically and mechanically engaging conductors 20 as best shown in FIG. 3. As best shown in FIG. 4, wedge 12 is constructed of an electrically conductive material such as an aluminum alloy, and is treated with an anodic coating 40' about its surface area. The surfaces of the concave sidewalls 14, however, are prepared in a similar manner to the inner surfaces of the inwardly facing channels of the C-member and are therefore free of the anodic coating 40'. Sidewalls 14 therefore have exposed surfaces for electrically and mechanically engaging and retaining conductors 20 as best shown in FIG. 3.

An embodiment of the present invention utilizes electrically conductive aluminum alloy as the material for the wedge and C-member described above. Effective parameters used in the anodization process produce an anodic coating in the range of 5 to 15 micrometers thick, however, various thicknesses of the anodic layer may be used to adjust the heat transfer performance of the connector. A particular anodic coating used in the present invention produced a wedge and C-member having a black appearance. The thermal transfer performance of the anodized wedge and C-member connector was greatly enhanced, dramatically increasing the total emissivity of the connector while minimally and inconsequentially increasing the solar absorptivity of the connector. That is, although the C-member and wedge of the present embodiment appeared black in color, when tested in overhead power line applications, the heating effect due to sunlight was negligible and, in fact, greatly outweighed by the thermal emissivity produced by the anodic coating.

It should be noted that when selecting a coating or surface treatment, solar absorptivity of the connector may not be a concern where emissive properties greatly overshadow the effects of high absorptivity. Moreover, in applications where the connector is not exposed to sunlight, solar absorptivity may be entirely dismissed as a factor.

Another embodiment of the present invention provides an electrical connector having a mating member of electrically conductive material, such as aluminum alloy, coated with a surface treatment, such as a paint or sealant. A complimentary mating member may, but need not be, similarly treated with such a coating.

A non-anodic coating or surface treatment may be utilized in this alternate embodiment provided that the coating or surface treatment increases the emissivity of the connector by altering the surface optical properties, while minimizing the insulative properties that may be introduced to the connector by such a surface treatment. Therefore, selection of an effective surface treatment or coating is guided by the goal to maximize emissivity and minimize insulative characteristics of the coated connector. Furthermore, if the connector selected to receive the coating is designed for outdoor use with direct exposure to sunlight (as are many power utility connectors), it is of course desirable to select a coating that will also minimize solar absorptivity.

One strategy for minimizing insulative properties introduced to an electrical connector by the addition of a high emissivity coating is to make that coating or surface treatment extremely thin. Of course, various thicknesses of surface treatments will result in varying emissivities. Therefore, laboratory experimentation and analysis are generally required to determine ideal thickness for each surface treatment or coating. Further, ideal thicknesses may vary from coating to coating in that some coatings may impart more or less insulative properties to a connector when applied in the same thickness.

In addition to surface treatment thickness, other general characteristics of the surface treatment may be considered when selecting a suitable coating that enhances emissivity. Color, for example, typically increases emissivity of a connector when the surface treatment is of darker color than the material of the connector which receives the treatment. By selecting a surface treatment with a darker color than the material being treated, the surface thermo-optical properties of the connector are altered in such a way that emissivity of the connector is increased. Similarly, adjusting the surface roughness or texture of the coating will affect emissivity. A matte or coarse finish typically enhances emissivity as compared to a smooth surface by favorably adjusting the surface thermo-optical properties of a treated material. Finally, favorable thermal conductivity of the coating itself may be exploited in order to improve performance of the connector by increasing emissivity.

Most coatings and surface treatments are by nature electrically non-conductive. However, an embodiment of the present invention provides an electrical connector constructed of electrically conductive material coated with a surface treatment that is also electrically conductive. The surface treatment serves to alter the surface optical characteristics of the connector so as to increase emissivity while increasing neither the insulative characteristics nor the solar absorptivity of the connector. The surface treatment of the present embodiment contains metal fines which act to lend electrically conductive properties to the surface coating.

Figure 5:
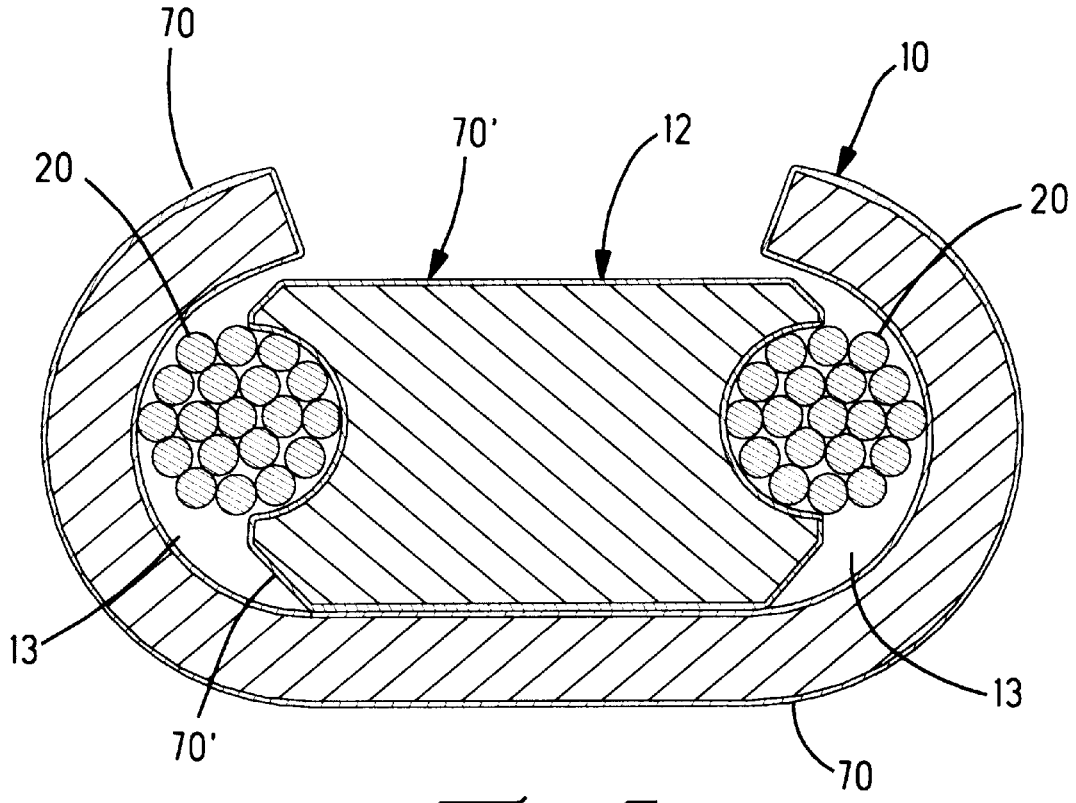
FIG. 5 is a cross-sectional view of a C-member and wedge connector having an electrically conductive surface treatment.

As shown in FIG. 5, a standard C-shaped member and wedge connector is shown having an electrically conductive surface treatment 70,70'. As such, it becomes unnecessary to specifically provide electrically conductive paths within the connector by masking or stripping the surface treatment. For instance, the traditional wedge and C-member connector, shown in FIG. 5 is coated with an electrically conductive surface treatment containing metal fines, wherein channels 13 of the C-member and concave sidewalls 14 of the wedge would not need to be free of the surface treatment. Masking and stripping in such a connector would be unnecessary.

Another embodiment of the present invention provides an electrical connector such as a traditional C-member and wedge, that is treated with a surface treatment or coating that is sufficiently thin so as to provide stripping of the surface treatment on the electrical contact surfaces during termination of the connection. For example, in a standard C-member and wedge connector, the C-member could be treated with an extremely thin surface treatment or coating about the entire surface area of the C-member. Similarly, the wedge could be coated with the same extremely thin surface treatment about its entire surface area. As indicated above, most coatings or surface treatments that increase emissivity within a connector, are electrically non-conductive by nature. However, by using a surface treatment that is extremely thin, the coating may be stripped away during termination of the connector by frictional engagement of the contact surfaces, thereby exposing the electrical contact surfaces to electrically conductive material that is free of the non-conductive coating. The surface treatment, therefore, would only be removed from the electrical contact surfaces during termination and would remain intact on the remainder of the electrical connector.

Figure 6:
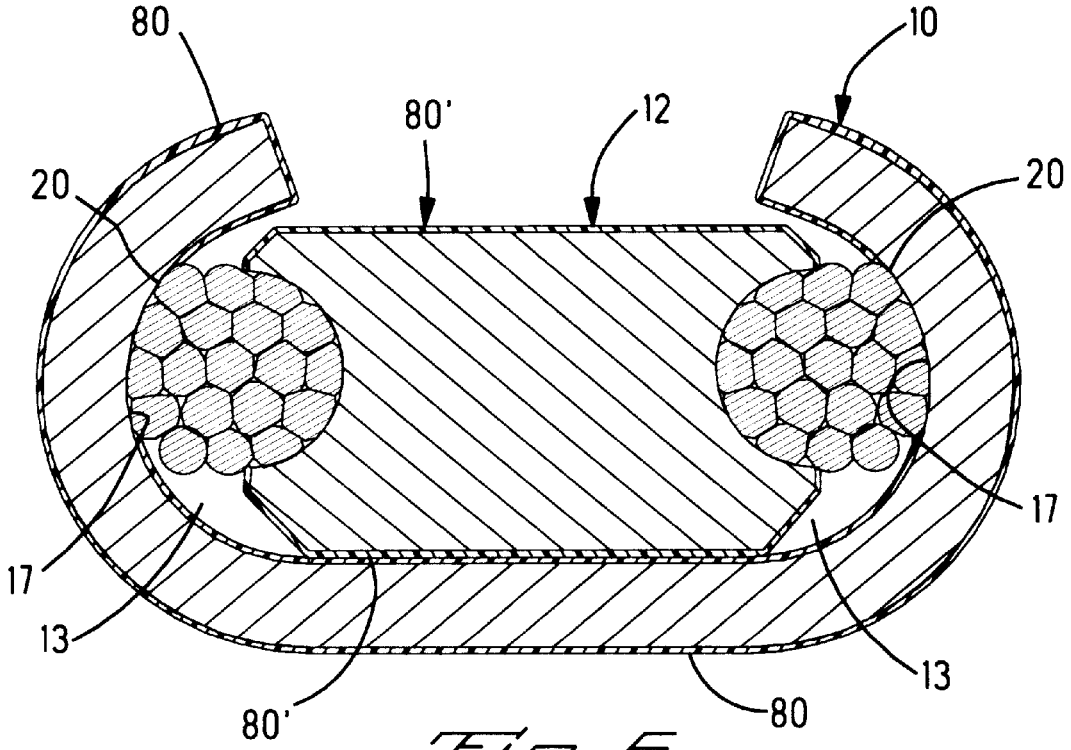
FIG. 6 is a cross-sectional view of a C-member and wedge connector having an extremely thin electrically non-conductive surface treatment.

As shown in FIG. 6, in the example of a C-member and wedge connector, termination of the connector would cause channel 13 of the C-member and concave sidewalls 14 of the wedge member to frictionally engage conductors 20. This frictional contact between conductors 20 and channels 13 and concave sidewalls 14 is sufficient to remove a portion of the extremely thin coating 80,80', as shown in FIG. 6, so that an electrically conductive path is provided within the connector without the need for masking or stripping of the surface coating.

Figure 7:
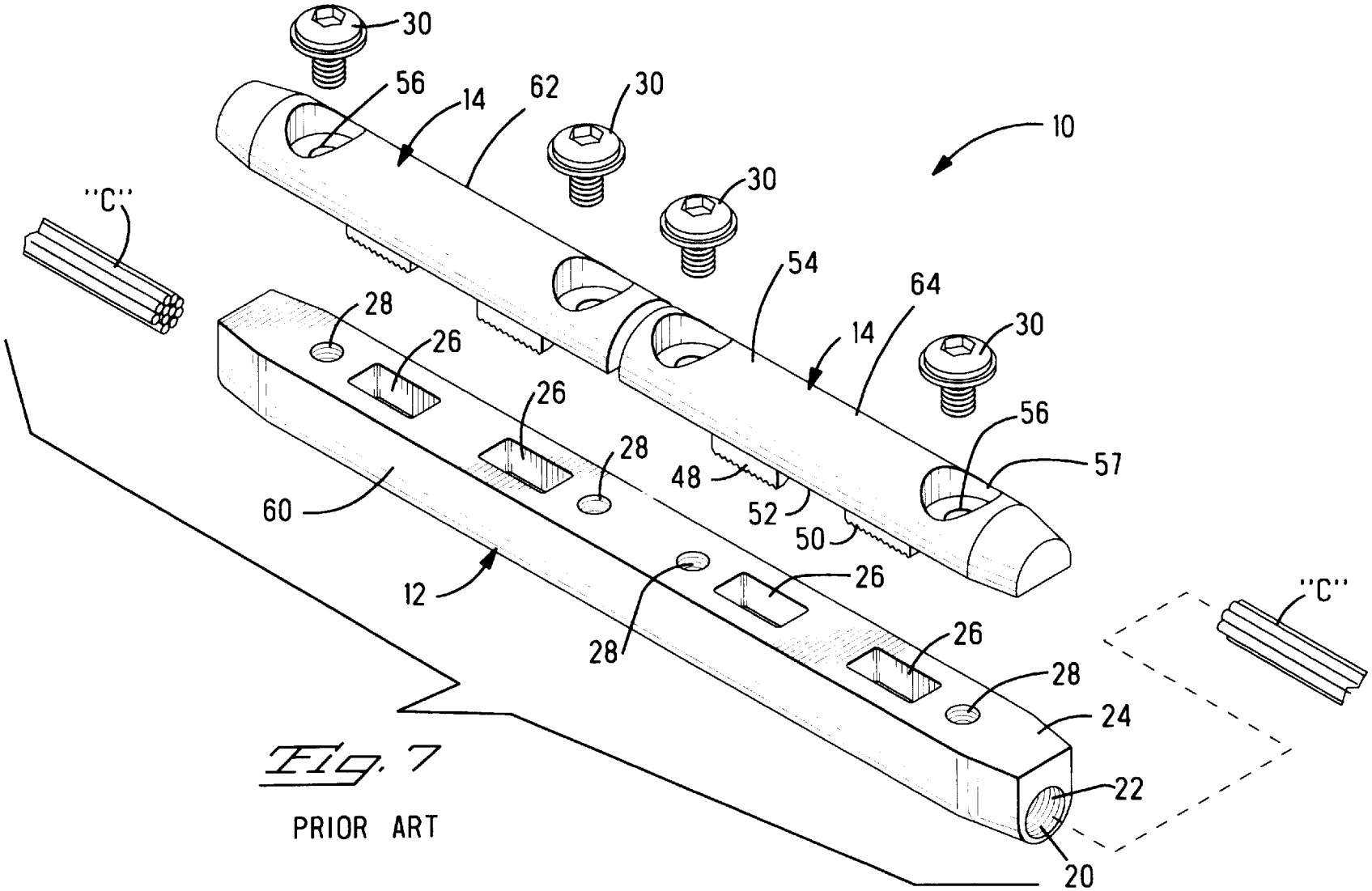
Fig. 7 PRIOR ART
FIG. 7 is an exploded isometric view of a prior art electrical connector without a surface treatment.
Figure 8:
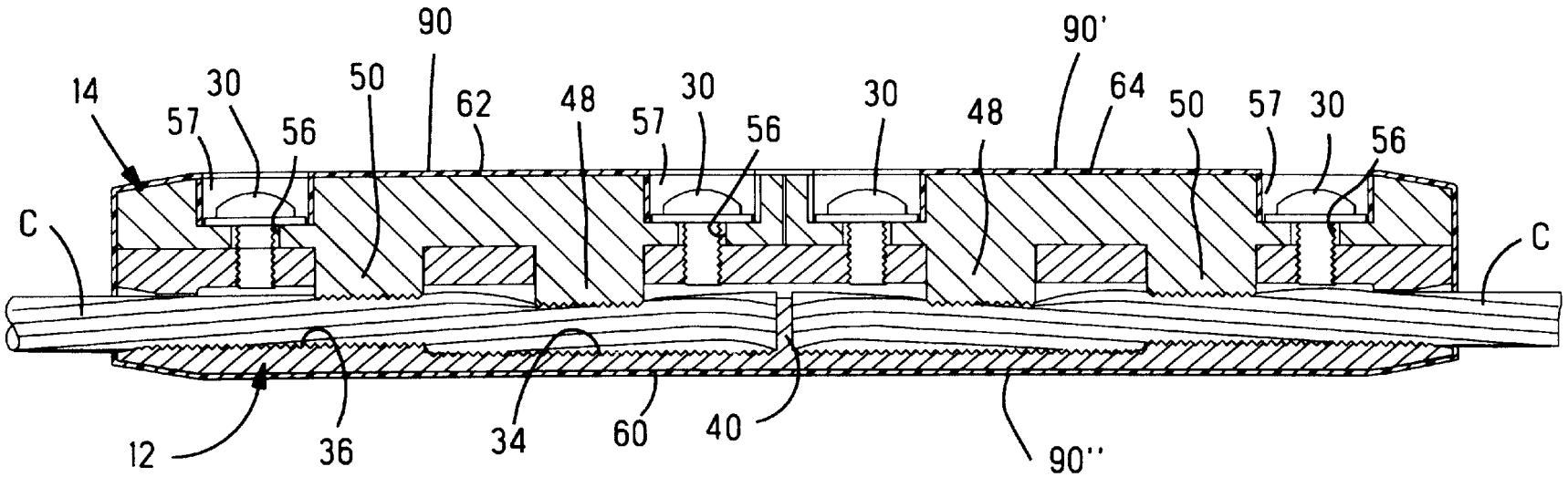
FIG. 8 is a cross-sectional view of the prior art electrical connector of FIG. 7 having a surface treatment for enhancing emissivity.

It must be understood that although an embodiment described herein utilized an aluminum alloy as the electrically conducting material for the C-member and wedge, other electrically conductive materials would perform similarly, provided that electrical contact surfaces were free of non-conductive coatings or coated with an electrically conductive treatment, thereby allowing electrical continuity within the connector. Furthermore, other types of electrical connectors than a standard C-member and wedge would be benefited by a surface treatment that enhances emissivity. For purposes of illustration only, another style of utility connector 10 is shown in FIG. 7. The connector 10, shown in FIG. 7 is used to splice two conductors C end to end, but is not treated with a surface treatment for enhancing emissivity. FIG. 8 illustrates the connector shown in FIG. 7 with a surface treatment for enhancing emissivity 90,90',90" applied to its exterior surfaces 60,62,64. Of course, other types of connectors that are not shown could be similarly treated.

An advantage of the present invention is that an electrical connector is provided with a built-in mechanism for emitting heat produced in the connector. Therefore, extra parts such as heat sinks are unnecessary to reduce the heat generated internally in the connector.

Another advantage of the present invention is that an electrical connector is provided having a built-in mechanism for emitting heat attributed to high current loads that is produced in most power utility connector applications. Therefore, degradation due to increased rates of oxidation, corrosion and inhibitor breakdown are avoided by due to the increased emissivity of heat.

Another advantage of the present invention is that a robust coating is provided on an electrical connector that is resistant to external elements, thereby extending the life of the connector.

The enhanced emissivity electrical connector of the present invention and many of its attendant advantages will be understood from the foregoing description. It is apparent that various changes may be made in the form, construction, and arrangement of parts thereof without departing from the spirit of the invention, or sacrificing all of its material advantages. Thus, while a present embodiment of the invention has been disclosed, it is to be understood that the invention is not strictly limited to such embodiment but may be otherwise variously embodied and practiced within the scope of the appended claims.

We claim:

1. An electrical connector comprising:

a tapered C-shaped member of electrically conductive material having an anodic coating, the C-shaped member forming two inwardly facing concave recesses, the recesses running longitudinally with the C-shaped member, each recess capable of receiving a length of an electrical conductor, and each recess having an electrically conductive surface portion free of the anodic coating; and a wedge having two concave sidewalls running longitudinally with the wedge, the sidewalls being positioned to engage and retain electrical conductors within the concave recesses of the C-shaped member.

2. The electrical connector of claim 1, wherein the wedge is constructed of electrically conductive material substantially covered by an anodic coating and the sidewalls are electrically conductive and substantially free of the anodic coating.

3. The electrical connector of claim 1, wherein the electrically conductive material of the C-shaped member and the wedge is aluminum alloy.

4. An electrical connector comprising:

a tapered C-shaped member of electrically conductive material having an anodic coating in the range of 5 to 15 micrometers thick, the C-shaped member forming two inwardly facing concave recesses, the recesses running longitudinally with the C-shaped member, each recess capable of receiving a length of an electrical conductor, and each recess having an electrically conductive surface portion free of the anodic coating; and a wedge having two concave sidewalls running longitudinally with the wedge, the sidewalls being positioned to engage and retain electrical conductors within the concave recesses of the C-shaped member, the wedge being constructed of electrically conductive material substantially free of said anodic coating.

5. The electrical connector of claim 3, wherein the electrically conductive material of the C-shaped member and the wedge is aluminum alloy.

6. An electrical connector comprising:

a tapered C-shaped member of electrically conductive material, the C-shaped member forming two inwardly facing concave recesses, the recesses running longitudinally with the C-shaped member, each recess capable of receiving a length of an electrical conductor;

a surface treatment coating the surface of the C-shaped member, wherein the surface treatment increases the emissivity of the connector; and a wedge having two concave side walls running longitudinally with the wedge, the sidewalls being positioned to engage and retain electrical conductors within the concave recesses of the C-shaped member.

7. The electrical connector of claim 6, wherein the surface treatment is electrically conductive.

8. The electrical connector of claim 6, wherein the surface of the wedge is coated with a surface treatment that increases the emissivity of the connector.

9. The electrical connector of claim 6, wherein the surface treatment is sufficiently thin to allow removal of the surface treatment from the concave recesses upon assembly of the wedge, electrical conductors and the C-shaped member.

10. The electrical connector of claim 8, wherein the surface treatment of the wedge is sufficiently thin to allow removal of the surface treatment from the sidewalls upon assembly of the wedge, electrical conductors and the C-shaped member.

11. An electrical connector comprising:

a tapered C-shaped member of electrically conductive material, the C-shaped member forming two inwardly facing concave recesses, the recesses running longitudinally with the C-shaped member, each recess capable of receiving a length of an electrical conductor;

a surface treatment coating the surface of the C-shaped member except for the inwardly facing concave recesses which are free of the surface treatment and electrically conductive, wherein the surface treatment increases the emissivity of the connector and a wedge having two concave sidewalls running longitudinally with the wedge, the sidewalls being positioned to engage and retain electrical conductors within the concave recesses of the C-shaped member.

12. The electrical connector of claim 11, wherein the surface treatment is electrically non-conductive.

13. The electrical connector claim 11, wherein the surface treatment is electrically conductive.

14. The electrical connector of claim 11, wherein the surface of the wedge is coated with a surface treatment that increases the emissivity of the connector.

15. The electrical connector of claim 11, wherein the surface treatment is sufficiently thin to allow removal of the surface treatment from the concave recesses upon assembly of the wedge, electrical conductors and the C-shaped member.

16. The electrical connector of claim 14, wherein the surface treatment of the wedge is sufficiently thin to allow removal of the surface treatment from the sidewalls upon assembly of the wedge, electrical conductors and the C-shaped member.

* * * * *